US006002332A

United States Patent [19]

King

[11] Patent Number: 6,002,332

[45] Date of Patent: *Dec. 14, 1999

[54] PASSIVE GARAGE DOOR OPERATOR SYSTEM

[75] Inventor: Joseph D. King, Ann Arbor, Mich.

[73] Assignee: Lear Corporation, Southfield, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 09/098,441

[22] Filed: Jun. 17, 1998

[51] Int. Cl.[6] ..... G08B 13/08

[52] U.S. Cl. ..... 340/545.1; 340/547; 340/941

[58] Field of Search ..... 340/905, 933, 340/941, 935, 938, 988, 991, 567, 545.1, 551

[56] References Cited

U.S. PATENT DOCUMENTS

| | | | |
|---|---|---|---|
| 3,683,328 | 8/1972 | Fayling | 340/988 |
| 3,714,625 | 1/1973 | Fayling | 340/988 |
| 3,753,223 | 8/1973 | Fayling | 340/988 |
| 4,185,265 | 1/1980 | Griffin et al. | 340/988 |
| 5,027,553 | 7/1991 | Vergara . | |
| 5,282,337 | 2/1994 | Duhame et al. | 49/199 |
| 5,369,591 | 11/1994 | Broxmeyer | 340/903 |
| 5,381,095 | 1/1995 | Andrews | 340/988 |
| 5,402,106 | 3/1995 | Dipaolo et al. | 340/572 |
| 5,680,134 | 10/1997 | Tsui . | |
| 5,689,236 | 11/1997 | Kister . | |

*Primary Examiner*—Nina Tong

*Attorney, Agent, or Firm*—Niro, Scavone, Haller & Niro

[57] ABSTRACT

A passive remote garage door operator system including a magnetic field sensor which detects a magnet having a flux density and a transmitter that sends a coded security signal to activate a garage door. A controller determines whether the magnet field sensor detects the magnet from a first direction or a second direction and activates the position of the garage door. The magnetic field sensor is preferably affixed to the underside of a vehicle and the magnets are embedded in a driveway leading to the garage. The system thereby automatically opens a garage door based upon the approach of a vehicle and closes automatically based upon the exit of the vehicle without any intervention by the human vehicle operator.

24 Claims, 1 Drawing Sheet

PASSIVE GARAGE DOOR OPERATOR SYSTEM

BACKGROUND OF THE INVENTION

The present invention relates to a wireless transmitter system for a vehicle, and more particularly to the passive remote operation of a garage door without active human intervention.

Transmitter-receiver controller systems are widely used for the remote actuation of devices such as garage doors, gates, security systems and the like. Most conventional garage door opening systems use a transmitter-receiver combination to selectively activate the drive source for opening or closing the garage door. The receiver is usually mounted adjacent to the drive source and receives a signal from a hand held transmitter. The transmitter is normally carried in the vehicle and selectively activated by a user to send the signal to open or close the garage door.

The majority of homes are currently being constructed with garage door openers having remote controllers using RF wireless technology. Further, many existing homes have been upgraded with garage door openers having this remote function. An associated trend in the automotive market is to provide new vehicles with factory installed universal transmitters which communicate with the various garage door openers. However, such systems must still be activated by a user to obtain the desired function of the garage door.

SUMMARY OF THE INVENTION

The present invention provides a passive remote garage door operator system in which the transmitter automatically opens a garage door when a vehicle approaches and closes automatically when a vehicle leaves without any intervention by the vehicle operator. A magnetic field sensor detects a magnet having a flux density and a transmitter sends a coded security signal in response to the detection of the flux density to activate the position of the garage door. The magnetic field sensor is preferably affixed to the underside of a vehicle and the magnets are embedded in a driveway leading to the garage, security gate, etc.

Preferably, the wireless transmitter system includes a controller which determines whether the magnet field sensor detects the magnet from a first direction or a second direction. This ability to distinguish the direction provides the passive transmitter system with the capability to send an "open" signal when the vehicle is heading toward the garage and a "close" signal when the vehicle is heading away from the garage.

BRIEF DESCRIPTION OF THE DRAWINGS

Other advantages of the present invention will be readily appreciated as the same becomes better understood by reference to the following detailed description based upon consideration in connection with the accompanying drawings wherein.

DETAILED DESCRIPTION OF THE PREFERRED EMBODIMENT

Figure 1:
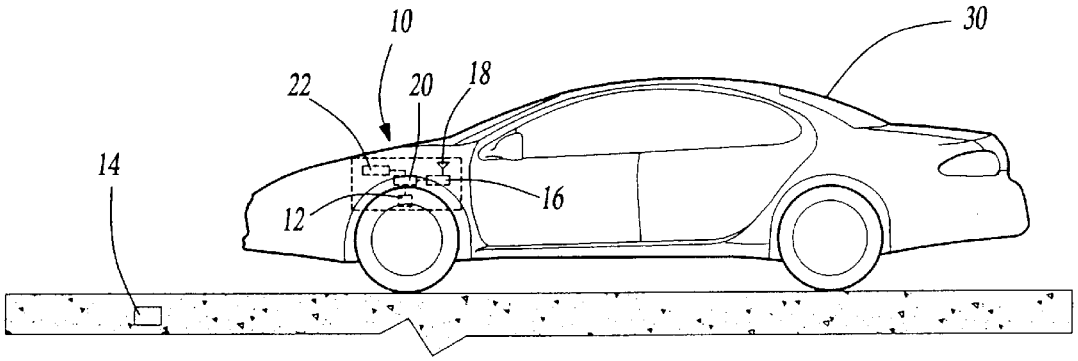
FIG. 1 is a schematic of the door opening transmitter system of the present invention.

A wireless transmitter system 10 according to the present invention is generally shown in FIG. 1. The transmitter system 10 includes a magnetic field sensor 12 for detecting a magnet 14 having a flux density and a transmitter 16 for sending a coded security signal in response to the detection of the flux density. In a preferred embodiment, the magnetic field sensor 12 is affixed to the underside of a vehicle 30. However, the magnetic field sensor 12 may be located in various positions in or around the vehicle depending on the location of the magnet 14.

The magnet 14 is preferably a permanent magnet 14 having a specific flux density. The flux density of the magnet 14 provides a specific characteristic which is sensed by the magnetic field sensor 12 thereby providing a measure of security and identity to the transmitter system 10.

The transmitter 16 transmits a coded security signal via an antenna system 18 appropriate to the technology of the transmitter 16. The transmitter 16 transmits in any known manner, such as RF, IR, or microwave and preferably includes a plurality of codes which may be encrypted or rolled according to known techniques.

The wireless transmitter system 10 may further include a controller 20 communicating between the magnet field sensor 12 and the transmitter 16. The controller 20 determines when the magnet field sensor 12 detects the magnet 14 and provides a degree of intelligence to the transmitter system 10. The controller 20 preferably determines the particular direction in which the magnet field sensor 12 passes the magnet 14. This directional discrimination function provides the controller 20 with the information required to determine whether a first coded security signal or a second coded security signal should be transmitted by the transmitter 16. For example, the ability to distinguish direction provides the wireless transmitter system 10 with the capability to send an "open" signal based when a vehicle is heading toward a garage and a "close" signal when the vehicle is heading away from the garage.

The wireless transmitter system 10 may further include an sensor suite 22 communicating with the controller 20. The sensor suite 22 may monitor the engine rpm, temperature, or other factor to provide a greater intelligence to the overall system 10. The sensor suite 22 may also be directly integrated with an on-board vehicle computer and any available information there associated may be used as input for the controller 20. Access to such vehicle information provides for further opportunities to particularly tailor the system 10 capabilities. By way of example only, the introduction of a sensor suite 22 which monitors engine temperature and vehicle speed provides the necessary intelligence to passively open a garage door based upon whether the user first starts the vehicle within the garage or closes the door after the vehicle is parked therein.

Figure 2:
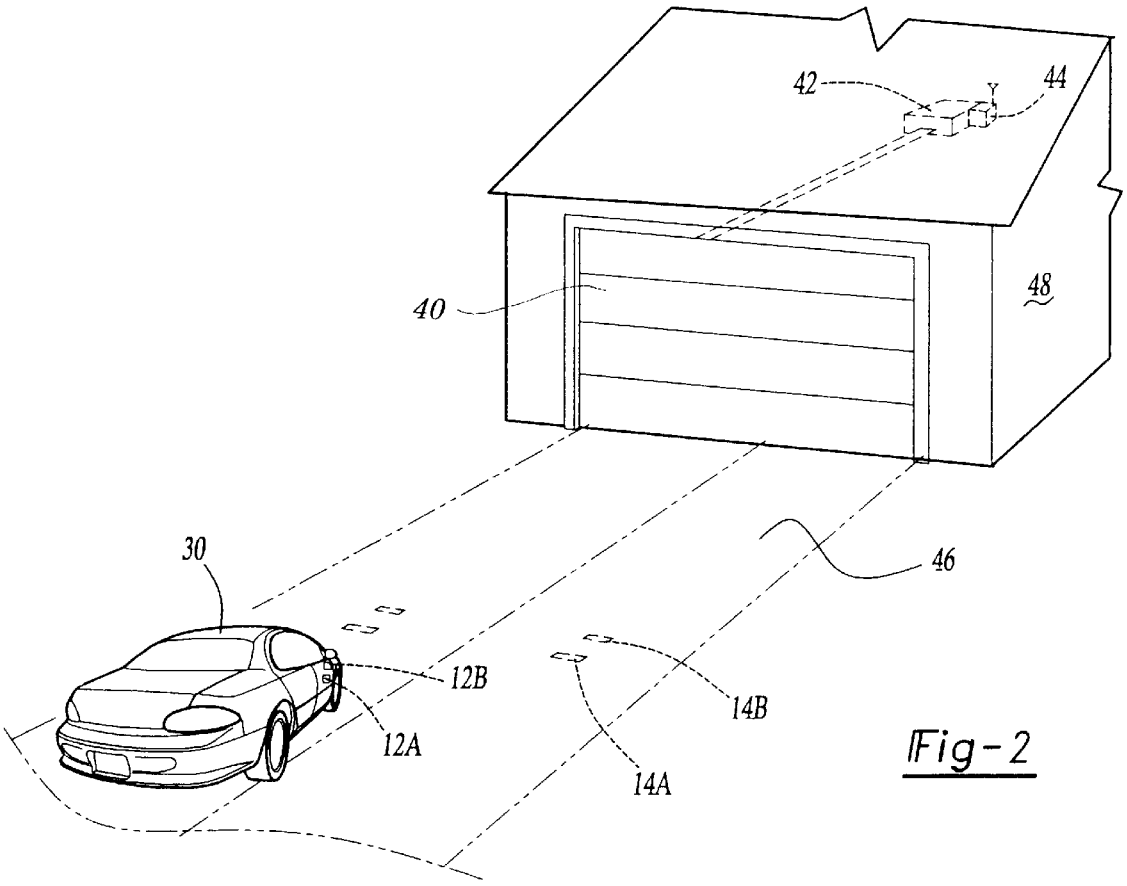
FIG. 2 illustrates a door opening system including the garage door opener transmitter system of FIG. 1.

FIG. 2 illustrates a garage door operator system including the passive transmitter system 10 of the present invention. A remotely activated garage door operator system includes a garage door 40, an actuator 42, and a receiver 44 which receives a coded security signal transmitted by the transmitter 16. In a preferred embodiment a first magnet 14A having a first flux density and a second magnet 14B having a second flux density are embedded in a driveway 46 leading to a garage 48. A first magnetic field sensor 12A and a second magnetic field sensor 12B for detecting the flux density from the magnets 14A–B is affixed to the underside of a vehicle 30.

As shown in FIG. 2, as the vehicle 30 approaches the garage 48 along the driveway 46 the magnetic field sensors 12A–B pass proximate to the magnets 14A–B. The magnetic field sensors 12A–B discriminate the separate distinct flux densities and preferably, a controller 20 determines the order in which the first flux density and the second flux density are detected. The controller 20 thereby determines the heading of the vehicle 30 and determines what signal to transmit. For example, if the vehicle 30 is traveling toward the garage 48 the first flux density is detected prior to the second flux density and the transmitter 16 sends an open signal to the receiver 44. The receiver 44 communicates the open signal to the actuator 42 to open the garage door 40. Conversely, as the vehicle 30 is leaving the garage 48 the second flux density is detected prior to the first flux density and a second coded security signal is sent to the receiver 44 that the garage door should be closed.

Although the magnets 14A–B are preferably shown as embedded in a road way and the magnetic field sensors 12A–B and transmitter 16 as located in the vehicle this should not be appreciated as a limiting arrangement. Many variations of sensor and magnet placement and/or quantity are possible. A single magnet 14A and a single magnetic field sensor 12A may be provided to simply toggle the garage door from an open to a closed position. In another embodiment, a single magnet 14A and a pair of magnetic field sensors 12A–B may be provided. The controller 20 would determine the order in which the magnet 14A is detected and send the appropriate signal. In a further embodiment, a pair of magnets 14A–B and a single magnetic field sensors 12A may be provided. Each magnet would have a distinct flux density and the controller 20 would thereby determine the order in which the magnets 14A–B are detected and send an appropriate signal. In yet another embodiment the magnets are affixed to the vehicle and the magnetic field sensor and transmitter are located at or near the entrance of a driveway, security gate, etc., thereby minimizing the duplication of expensive components. Further, a manual user interface may be provided allowing the operator to override or program the system.

The present invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described without departing from its spirit or scope.

What is claimed is:

1. A wireless transmitter system for activating from a vehicle a device associated with the security of a dwelling while the vehicle is remote from the dwelling, the system comprising:

a magnetic field sensor for detecting a magnet having a flux density in the path of the vehicle when it is proximate to the dwelling; and a transmitter responsive to the detection of said flux density for sending a coded security signal that activates the device without intervention by an occupant of the vehicle.

2. The wireless transmitter system of claim 1, wherein said magnetic field sensor detects a magnet embedded in a driveway associated with the dwelling.

3. The wireless transmitter system of claim 2, wherein said magnetic field sensor is affixed to the underside of the vehicle.

4. The wireless transmitter system of claim 1, further comprising a controller for determining a direction of the vehicle travel relative to said magnet based upon detection thereof by said magnetic field sensor.

5. The wireless transmitter system of claim 4, wherein said controller determines whether said magnet field sensor detects said magnet from a first direction or a second direction, said transmitter sending a first coded security signal based upon said controller determining said first direction and said transmitter sending a second position signal based upon said controller determining said second direction.

6. The wireless transmitter system of claim 5, wherein said magnet further comprises a first magnet having a first flux density and a second magnet having a second flux density.

7. The wireless transmitter system of claim 6, wherein said magnetic field sensor further comprises a first magnetic field sensor and a second magnetic field sensor.

8. The wireless transmitter system of claim 7, further comprising a sensor suite for communicating with said controller.

9. The wireless transmitter system of claim 8, wherein said sensor suite communicates with an on-board vehicle computer.

10. A garage door operator system for operating a garage door of a dwelling from a vehicle, the system comprising:

a first magnet for mounting remote from the dwelling and having a first flux density;

a first magnetic field sensor for mounting on the vehicle to detect said first flux density; and a transmitter for mounting on the vehicle to send a garage door activation signal in response to detection of said first flux density by said first magnetic field sensor without active intervention by an occupant of the vehicle.

11. The garage door operator system of claim 10, further comprising a receiver and a motor, said receiver communicating with said transmitter to receive said coded security signal and said motor operating the garage door based upon said position signal.

12. The garage door operator system of claim 10, further comprising a second magnet having a second flux density.

13. The garage door operator system of claim 12, wherein said first magnet and said second magnet are embedded in a driveway.

14. The garage door operator system of claim 13, further comprising a controller for determining the order in which said first flux density and said second flux density are detected, said controller communicating with said transmitter to send a first coded security signal to the garage door based upon detection of said first flux density is detected prior to detection of said second flux density and a second coded security signal to the garage door based upon said second flux density is detected prior to said first flux density.

15. The garage door operator system of claim 14, further comprising a second magnetic field sensor.

16. The garage door operator system of claim 15, wherein said first magnetic field sensor and said second magnetic field sensor are affixed to the underside of a vehicle, said first magnetic field sensor being affixed generally toward the front of the vehicle and said second magnetic field sensor being affixed generally toward the rear of the vehicle.

17. The garage door operator system of claim 16, further comprising a controller for determining the order in which said first magnetic field sensor and said second magnetic field sensor detect said flux density, said controller communicating with said transmitter to send a first coded security signal to the garage door based upon said first magnetic field sensor detecting said flux density prior to said second magnetic field sensor detecting said flux density and a second coded security signal based upon said second magnetic field sensor detecting said flux density prior to said first magnetic field sensor detecting said flux density to the garage door.

18. A method of transmitting a signal from a vehicle to a device associated with the security of a dwelling while the vehicle is remote from the dwelling, the method comprising the steps of:

(a) providing a vehicle having a magnetic field sensor mounted thereon;

(b) passing the vehicle proximate to a magnet having a flux density to detect said flux density by said magnetic field sensor; and (c) transmitting a coded security signal in response to the detection of said flux density to activate the device without intervention by an occupant of the vehicle.

19. A method as recited in claim 18, wherein said magnetic field sensor is affixed to the vehicle and detects said flux density based upon the vehicle passing proximate to said magnet.

20. A method as recited in claim 19, further comprises determining the direction of the vehicle and transmitting a first signal based upon the vehicle passing said magnet in a first direction and transmitting a second signal based upon the vehicle passing said magnet in a second direction.

21. The wireless transmitter system of claim 1, wherein said coded security signal activates a garage door.

22. The wireless transmitter system of claim 1, wherein said coded security signal activates a home security system.

23. A method as recited in claim 18, further comprising, (d) receiving said coded security signal; and (e) operating a garage door in response to said signal.

24. A method as recited in claim 18, further comprising, (d) receiving said coded security signal; and (e) operating a home security system in response to said signal.

* * * * *